United States Patent [19]

Plyler et al.

[11] 4,169,654

[45] Oct. 2, 1979

[54] PIN TYPE ELECTRICAL CONTACT TERMINAL

[75] Inventors: Robert G. Plyler, Vienna; Lyle B. Suverison, Fowler, both of Ohio

[73] Assignee: General Motors Corporation, Detroit, Mich.

[21] Appl. No.: 880,439

[22] Filed: Feb. 23, 1978

Related U.S. Application Data

[63] Continuation-in-part of Ser. No. 798,569, May 19, 1977, abandoned.

[51] Int. Cl.[2] ..... H01R 13/06

[52] U.S. Cl. ..... 339/252 P

[58] Field of Search ..... 339/252 R, 252 P, 252 S, 339/176

[56] References Cited

U.S. PATENT DOCUMENTS

| | | | |
|---|---|---|---|
| 2,004,555 | 6/1935 | Kleinmann et al. | 339/252 P |
| 3,693,140 | 9/1972 | Nijman | 339/252 P |

FOREIGN PATENT DOCUMENTS

| | | | |
|---|---|---|---|
| 6412180 | 4/1965 | Netherlands | 339/176 M |

*Primary Examiner*—Joseph H. McGlynn
*Attorney, Agent, or Firm*—F. J. Fodale

[57] ABSTRACT

A one-piece sheet metal pin type electrical contact terminal comprises an intermediate split sleeve having a probe extending from one end and a lead wire attachment portion extending from the other end. The probe comprises a pair of longitudinal arms having tips which engage to permit elongation of the probe while stiffening the individual deflection characteristics of each arm. The terminal may be modified to include an integral tab at the end of one tip which is bent over the other tip to protect the tips from being spread apart.

3 Claims, 14 Drawing Figures

PIN TYPE ELECTRICAL CONTACT TERMINAL

This is a continuation-in-part of application Ser. No. 798,569 filed May 19, 1977, now abandoned.

This invention relates generally to pin type electrical contact terminals and more specifically to pin type electrical contact terminals of one-piece sheet metal construction.

The U.S. Pat. No. 3,697,931 granted to Kurt Joseph Achten on Oct. 10, 1972 for an "Electrical Plug Contact" discloses in FIG. 26 a prior art pin type electrical contact terminal of one-piece sheet metal construction characterized by a probe 14*b* comprising a pair of longitudinal arms 16*b*. The arms are connected together at the forward end by a bullet nose tip. One arm is integrally connected to a ferrule 12*b* and extends longitudinally therefrom. The rearward end of the other arm is disposed inside the ferrule and retained against axial separation. The arms have a plurality of substantially normally disposed tabs 80 which abut when the probe 14*b* is compressed in an associated socket connector terminal to produce a column effect which resists bending.

A major drawback of this prior art pin type electrical contact terminal is that there is no provision to accommodate elongation of the probe when it is compressed in its associated socket connector terminal. This appears particularly troublesome in view of the bullet shaped tip which is already highly stressed as a result of its formation from a flat blank. Formation of the terminal also involves complicated forming procedures to dispose the rearward end of one arm in the ferrule. Also the possibly burred stamped edges are utilized at locations which engage other portions of the terminal or the associated socket terminal.

The object of this invention is to provide an improved pin type electrical contact terminal in general and to improve upon the aforesaid pin type electrical contact terminal in particular.

Another object of this invention is to provide a pin type electrical contact terminal of one-piece sheet metal construction which accommodates elongation of the probe portion as it is radially compressed upon insertion into an associated socket connector terminal.

Another object of this invention is to provide a pin type electrical contact terminal of one-piece sheet metal construction which does not require formation of shapes which produce high stress concentrations and thus can be made of heavier stock material.

A feature of the invention is that the probe arms may be shaped to alleviate the effects of burrs which may possibly be formed at the stamped edges.

Another features of the invention is that the terminal may be modified to include means to protect against the tips of the probe being spread apart by improper handling or mating.

Figure 1:
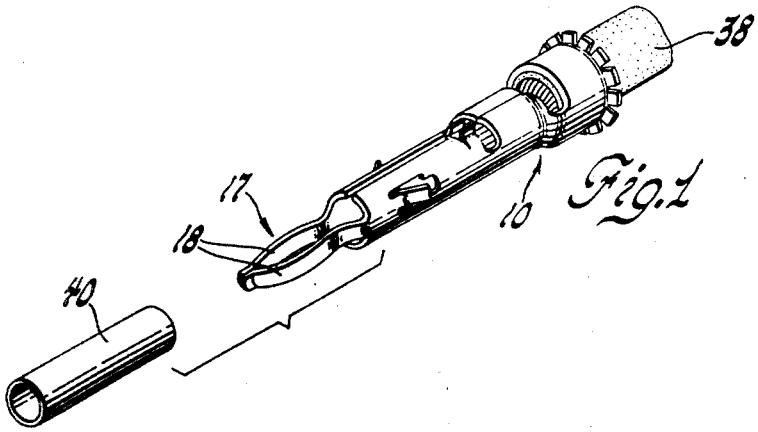
Figure 2:
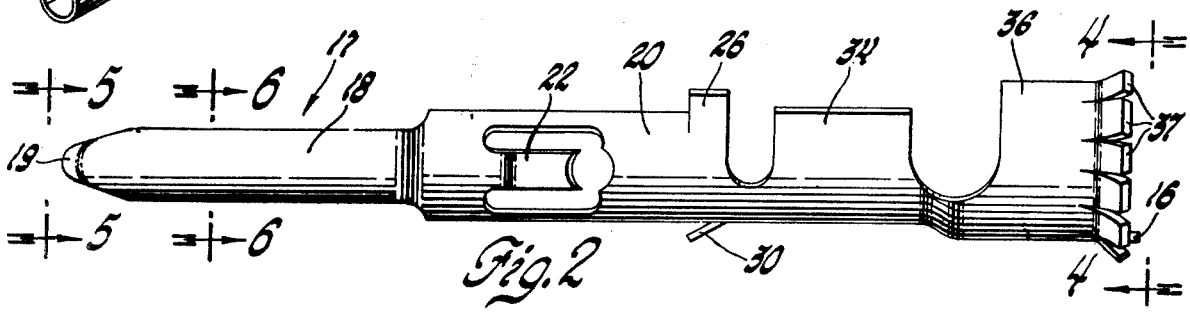
Figure 3:
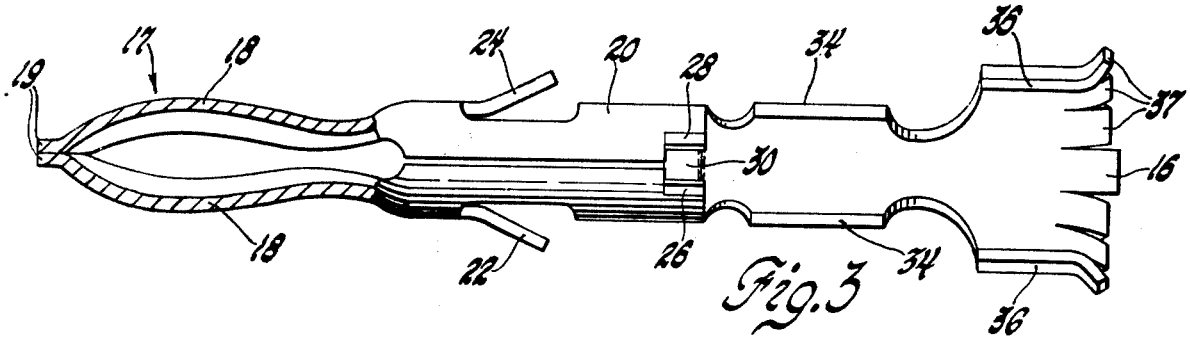
Figure 4:
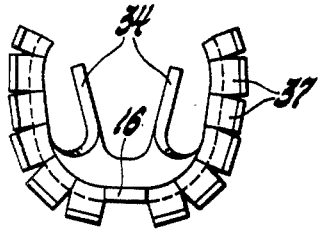
Figure 6:
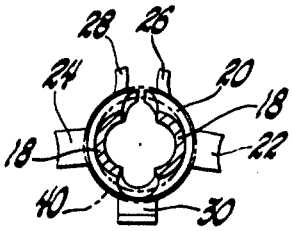
Figure 5:
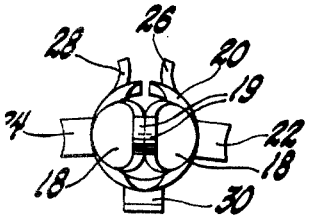
Figure 7:
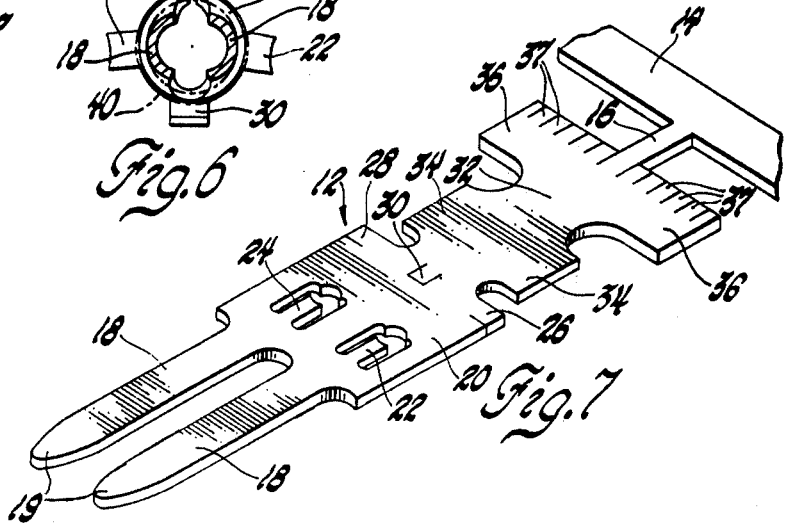
Figure 8:
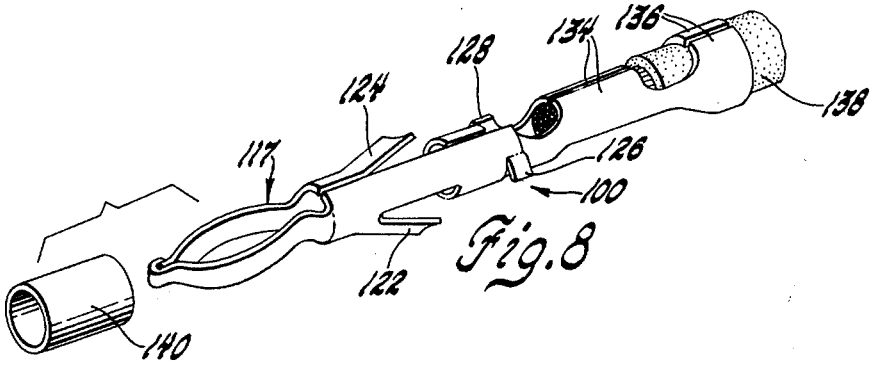
Figure 9:
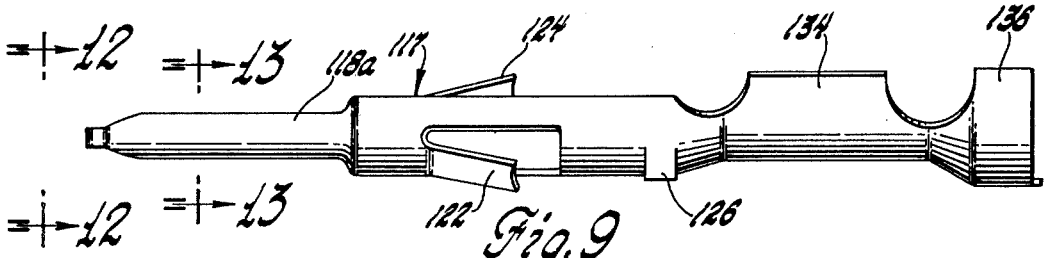
Figure 10:
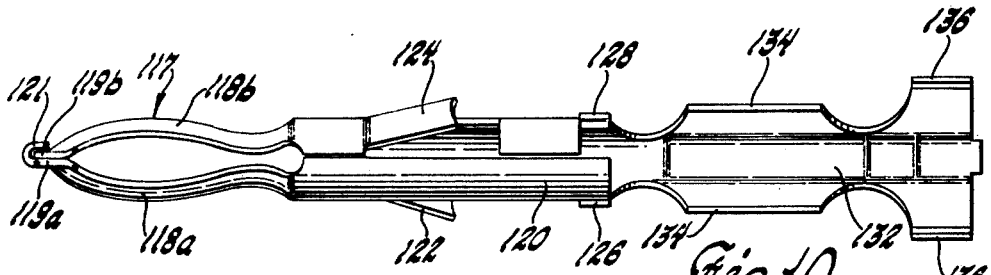
Figure 11:
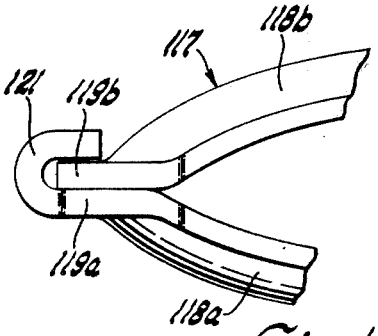
Figure 13:
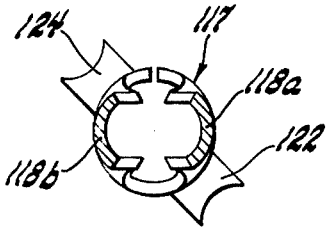
Figure 12:
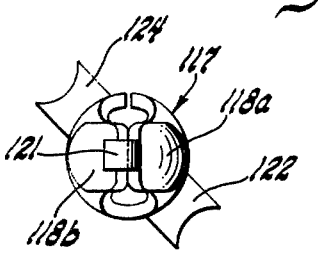
Figure 14:
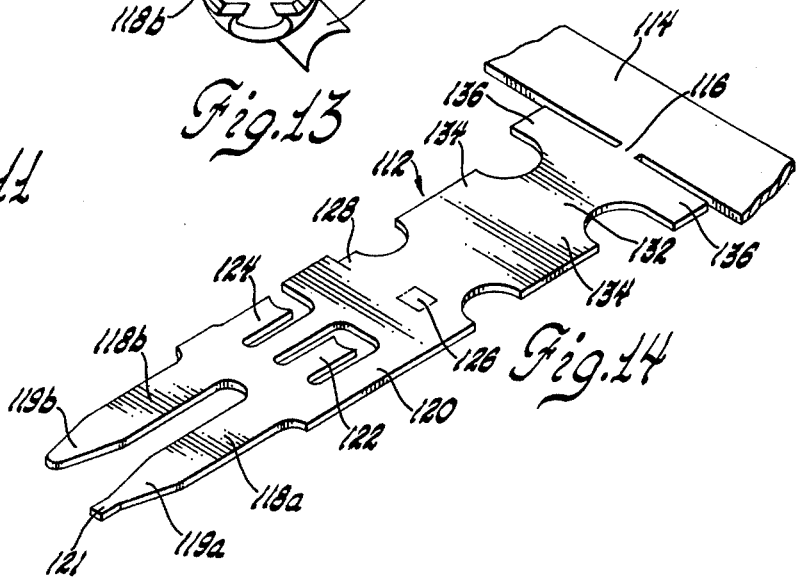

Other objects and features of the invention will become apparent to those skilled in the art as the disclosure is made in the following detailed description of a preferred embodiment of the invention as illustrated in the accompanying sheets of drawing in which:

FIG. 1 is a perspective view of a pin type electrical contact terminal in accordance with this invention shown juxtaposed an associated socket type electrical contact terminal representatively illustrated as a seamless tube, FIG. 2 is a side view of the pin type electrical contact terminal shown in FIG. 1 prior to being attached to a lead wire, FIG. 3 is a partially sectioned top view of the pin type electrical contact terminal shown in FIG. 2, FIGS. 4 and 5 are rear and forward end views respectively of the pin type electrical contact terminal along the lines 4—4 and 5—5 respectively of FIG. 2, FIG. 6 is a section taken along the line 6—6 of FIG. 2, FIG. 7 is a perspective view of the sheet metal blank from which the pin type electrical contact terminal shown in FIGS. 1–6 is formed, FIG. 8 is a perspective view of a modified pin type electrical contact terminal in accordance with this invention shown juxtaposed an associated socket type electrical contact terminal representatively illustrated as a seamless tube, FIG. 9 is a side view of the pin type electrical contact terminal shown in FIG. 8 prior to being attached to a lead wire, FIG. 10 is a top view of the pin type electrical contact terminal shown in FIG. 9, FIG. 11 is an enlargement of the tip portion of the terminal shown in FIG. 10, FIG. 12 is a front end view of the pin type electrical contact terminal along the lines 12—12 of FIG. 9, FIG. 13 is a section taken along the line 13—13 of FIG. 9, and FIG. 14 is a perspective view of the sheet metal blank from which the pin type electrical contact terminal shown in FIGS. 8–13 is formed.

Referring now to the drawings and more particularly to FIG. 1 there is shown a pin type electrical contact terminal 10 of one-piece sheet metal construction, in accordance with this invention.

The terminal 10 is made by stamping sheet metal strip stock to form a series of blanks like the flat blank 12 shown in FIG. 7 connected to a carrier strip 14 by a small tab 16. The blank 12 has a pair of parallel arms 18 at the forward end which are connected to an intermediate portion 20 of generally rectangular shape. The rectangularly shaped intermediate portion 20 is cut through at several locations to provide two lanced tabs 22 and 24 at the forward end, and three tabs 26, 28 and 30 at the rearward end. The tabs 26 and 28 are formed by lateral slits extending from the side edges while the tab 30 is lanced from the middle.

The blank 12 further includes a rear portion 32 which is integrally connected to the intermediate portion 20. The rear portion 32 is stamped to provide conventional pairs of core and insulation crimp wings 34 and 36 respectively. The rear edge portion of the insulation crimp wings 36 coincident the rear edge of the terminal may be provided with a plurality of fairly closely spaced longitudinal slits to ultimately form a number of locking flares 37.

During the formation of the terminal from the flat blank 12, the rectangularly shaped intermediate portion 20 is rolled into an intermediate split barrel, the tabs 22 and 24 having previously been bent outwardly to provide lock tangs and the tabs 26, 28 and 30 having been bent outwardly to provide forward stops. The crimp wings 34 and 36 are also rolled into a U-shape trough for attachment to a lead wire with the slitted rearward portion being bent radially outwardly to form a number of locking flares 37.

In the formation of the probe 17, the longitudinal arms 18 are shaped so as to converge slightly adjacent the split barrel 20 and then bow radially outwardly in the longitudinal direction as best shown in FIG. 3. In the transverse direction the arms 18 are shaped with a concavo-convex cross section which is convex in the radially outward direction as best shown in FIG. 6. The radius of curvature for the transverse cross section is preferably less than that of the associated socket so that each arm makes point contact thus avoiding engagement by the edges of the arms which may have burrs resulting from their formation. The preferably flat tips 19 of the arms 18 frictionally engage each other and form a slip joint at the forward end of the probe 17.

In practice, a plurality of terminals in the stage of manufacture shown in FIGS. 2–6 are provided in a reel with the terminals connected at spaced intervals to a wound up carrier strip 14. The terminals are then attached to individual lead wires by automated machinery which severs the lead terminal from the reel and crimps the wings 34 and 36 to the core and insulation of a prepared lead wire 38 as shown in FIG. 1.

The pin type electrical contact terminal 10 attached to the lead wire 38 is normally inserted into an open ended terminal cavity extending through an insulative connector body (not shown); the tabs 26, 28 and 30 serving as forward stops engaging rearwardly facing shoulder means in the cavity and the tabs 22 and 24 serving as lock tangs snapping over and engaging forwardly facing shoulder means in the cavity to prevent removal of the terminal. The locking flares 37 may be disposed in a rearward conical portion of the cavity to provide a second or alternative forward stop. The insulator body may also have a hinge flap movable to a position where a slotted bar engages behind the flares 37 with the lead wire extending through the slot to provide a secondary rearward lock.

The pin type electrical contact terminal 10 is adapted to be electrically connected to a socket type electrical contact terminal representatively illustrated as a seamless tube 40 in FIG. 1 by insertion of the probe 17 comprising the pair of longitudinal resilient arms 18. The arms 18 have a maximum lateral spread greater than the internal diameter of the seamless tube 40 and when received in the seamless tube 40 are radially compressed for biased engagement against the inner wall of the relatively rigid seamless tube.

Responsive to the radial compression, the pair of arms 18 elongate in the longitudinal direction which is accommodated by the slip joint formed by the frictionally engaged tips 19. This slip joint permits elongation of the probe 17 while buttressing the forward ends of each of the arms 18 to stiffen its individual deflection characteristics.

Referring now to FIG. 8 there is shown a pin type electrical contact terminal 100 of one-piece sheet metal construction, in accordance with this invention, which is modified to include means to protect against the tips of the probe being spread apart by improper handling or mating.

The modified terminal 100 is made by stamping sheet metal strip stock to form a series of blanks like the flat blank 112 shown in FIG. 7 connected to a carrier strip 114 by a small tab 116. The blank 112 has a pair of parallel arms **118*a* and 118*b* at the forward end which are connected to an intermediate portion 120 of generally rectangular shape. The arms 118*a* has a tapered tip 119*a* which merges into an integral tab 121 at its extremity. The arm 118*b* has a tapered tip 119*b*** with a rounded nose.

The rectangularly shaped intermediate portion 120 is pierced at several locations to provide two longitudinal tabs 122 and 124 at the forward end, and two lateral tabs 126 and 128 at the rearward end.

The blank 112 further includes a rear portion 132 which is integrally connected to the intermediate portion 120. The rear portion 132 is stamped to provide conventional pairs of core and insulation crimp wings 134 and 136 respectively.

During the formation of the terminal from the flat blank 112, the rectangularly shaped intermediate portion 120 is rolled into an intermediate split barrel, the tabs 122 and 124 having previously been bent outwardly to provide lock tangs and the tabs 126 and 128 having been bent outwardly to provide forward stops. The crimp wings 134 and 136 are also rolled into a U-shaped trough for attachment to a lead wire 138.

In the formation of the probe 117, the longitudinal arms **118*a* and 118*b* are shaped so as to converge slightly adjacent the split barrel 120 and then bow radially outwardly in the longitudinal direction as best shown in FIG. 10. In the transverse direction the arms 118*a* and 118*b* are shaped with a concavo-convex cross section which is convex in the radially outward direction as best shown in FIG. 13. The radius of curvature for the transverse cross section is preferably less than that of the associated socket so that each arm makes point contact thus avoiding engagement by the edges of the arms which may have burrs resulting from their formation. The preferably flat tips 119*a* and 119*b* of the arms 118*a* and 118*b* respectively, frictionally engage each other and form a slip joint at the forward end of the probe 117**.

In order to insure the integrity of the slip joint, the probe 117 of the modified terminal 100 is provided with means to protect against the possibility of the tips **119*a* and 119*b* being spread apart from improper handling, mating or the like. The protection means is in the form of the integral tab 121 at the extremity of the tip 119*a* which is bent over the tip 119*b* into a U-shaped configuration. The U-shaped tab 121 is spaced slightly from the tip 119*b* in the radial and longitudinal directions to permit the engaged tips 119*a* and 119*b* to slip relative to one another so as to accommodate elongation of the probe 117** when it is inserted into a mating female terminal.

In practice, a plurality of terminals in the stage of manufacture shown in FIGS. 9–13 are provided in a reel with the terminals connected at spaced intervals to a wound up carrier strip 114. The terminals are then attached to individual lead wires by automated machinery which severs the lead terminal from the reel and crimps the wings 134 and 136 to the core and insulation of a prepared lead wire 138 as shown in FIG. 8.

The pin type electrical contact terminal 100 attached to the lead wire 138 is normally inserted into an open ended terminal cavity extending through an insulative connector body (not shown); the tabs 126 and 128 serving as forward stops engaging rearwardly facing shoulder means in the cavity and the tabs 122 and 124 serving as lock tangs snapping over and engaging forwardly facing shoulder means in the cavity to prevent removal of the terminal.

The pin type electrical contact terminal 100 is adapted to be electrically connected to a socket type electrical contact terminal representatively illustrated as a seamless tube 140 in FIG. 8 by insertion of the probe 117 comprising the pair of longitudinal resilient arms 118*a* and 118*b*. The arms 118*a* and 118*b* have a maximum lateral spread greater than the internal diameter of the seamless tube 140 and when received in the seamless tube 140 are radially compressed for biased engagement against the inner wall of the relatively rigid seamless tube.

Responsive to the radial compression, the pair of arms 118*a* and 118*b* elongate in the longitudinal direction which is accommodated by the slip joint formed by the frictionally engaged tips 119*a* and 119*b*. This slip joint permits elongation of the probe 117 while buttressing the forward ends of each of the arms 118*a* and 118*b* to stiffen its individual deflection characteristics. The U-shaped tab 121 provides protection against the possibility of the tips being spread apart by improper handling or off center insertion into the female terminal while also permitting adequate operation of the slip joint.

As can be seen by comparing FIGS. 1–7 with FIGS. 8–14, the terminals 10 and 100 differ in minor respects such as the location and number of locking tabs or the use of locking flares. The major distinction, however, is the inclusion of the protection means comprising tab 121. This protection means may be incorporated in terminal 10 or other pin type electrical contact terminals of the same general construction.

We wish it to be understood that we do not desire to be limited to the exact details of construction shown and described, for obvious modifications will occur to a person skilled in the art.

We claim:

1. A one-piece, sheet metal pin type electrical contact terminal comprising:

an intermediate split sleeve having a longitudinal axis;

a forward probe comprising a pair of arms integrally connected to one end of the split sleeve at respective circumferentially spaced locations, each of said arms extending generally longitudinally from the one end of the split sleeve and each having a portion bowed radially outwardly in the longitudinal direction so as to biasingly engage an associated socket connector terminal when inserted thereinto, each of said arms having a tip at the end thereof remote from the split sleeve which engages a tip of another arm to form a slip joint which permits elongation of the probe while buttressing each arm to stiffen its individual deflection characteristics in the radially inward direction upon insertion of the probe into the associated socket connector terminal, an integral tab at the end of one of said engaged tips which is bent over the other of said engaged tips to protect against the engaged tips being spread apart, and an attachment portion integrally connected to the other end of the split sleeve.

2. In a one-piece, sheet metal pin type electrical contact terminal having a forward probe comprising a plurality of arms integrally connected to and extending generally longitudinally from one end of a split sleeve and terminating in a tip which engages a tip of another arm to form a slip joint which permits elongation of the probe while buttressing each arm to stiffen its individual deflection characteristics in the radially inward direction upon insertion of the probe into an associated socket connector terminal the improvement comprising an integral tab at the end of one of said engaged tips which is bent over the other of said engaged tips to protect against the engaged tips being spread apart.

3. In a one-piece, sheet metal pin type electrical contact terminal having a forward probe comprising a pair of arms integrally connected to and extending generally longitudinally from one end of a split sleeve and terminating in flat tips which engage each other to form a slip joint which permits elongation of the probe while buttressing each arm to stiffen its individual deflection characteristics in the radially inward direction upon insertion of the probe into an associated socket connector terminal the improvement comprising an integral tab at the end of one of said engaged tips which is bent over the other of said engaged tips to protect against the engaged tips being spread apart, said integral tab being U-shaped and spaced slightly from the other of said engaged tips in the radial and longitudinal directions.

* * * * *